United States Patent [19]

Searby

[11] 4,173,934

[45] Nov. 13, 1979

[54] SHELVING STRUCTURE

[75] Inventor: Dennis deB. Searby, Burlington, Canada

[73] Assignee: Speedshelf International, Inc., Skokie, Ill.

[21] Appl. No.: 831,524

[22] Filed: Sep. 8, 1977

[30] Foreign Application Priority Data

Sep. 24, 1976 [CA] Canada ..... 262040

[51] Int. Cl.[2] ..... A47B 3/00

[52] U.S. Cl. ..... 108/111; 211/190

[58] Field of Search ..... 108/107–109, 108/111; 211/187, 190–192

[56] References Cited

U.S. PATENT DOCUMENTS

| | | | |
|---|---|---|---|
| 1,411,260 | 4/1922 | Baker et al. | 108/107 |
| 1,814,090 | 7/1931 | Mically | 108/109 |
| 2,896,794 | 7/1959 | Jarvis | 108/109 |
| 2,907,471 | 10/1959 | Henry | 108/109 |
| 3,100,460 | 8/1963 | McElroy | 108/109 |
| 3,195,735 | 7/1965 | Jay | 211/191 X |
| 3,244,127 | 4/1966 | Evans | 108/108 |
| 3,263,821 | 8/1966 | Klene et al. | 211/190 |
| 3,672,515 | 6/1972 | Rous | 211/191 |
| 3,693,556 | 9/1972 | Rous | 108/109 |

FOREIGN PATENT DOCUMENTS

| | | |
|---|---|---|
| 666850 | 7/1963 | Canada . |
| 687764 | 6/1964 | Canada . |
| 713402 | 7/1965 | Canada . |
| 729006 | 3/1966 | Canada . |
| 760287 | 6/1967 | Canada . |
| 873717 | 6/1971 | Canada . |
| 933115 | 9/1973 | Canada . |
| 933116 | 9/1973 | Canada . |

*Primary Examiner*—James C. Mitchell

*Attorney, Agent, or Firm*—Cushman, Darby & Cushman

[57] ABSTRACT

The specification discloses a vertical framework structure extendable in both lateral and longitudinal directions. The structure comprises a plurality of vertical columns which are tubular members having a rectangular cross-section. At least two vertical opposing faces of the column are provided with a series of pairs of vertically and horizontally aligned spaced mounting slots. The structure further includes at least one lateral bracing member adapted to support a shelf, and extending between a pair of front and rear vertical columns. Each end of said lateral bracing member is formed with a pair of mounting lugs projecting at right angles to the plane of the bracing member, arranged in vertical alignment and spaced apart vertically a distance equal to the vertical spacing of the mounting slots on the column. At least one mounting lug has a locking means at the lower portion thereof. The horizontal bracing member has at a side surface thereof one or more upwardly extending shelf support flanges. A shelving structure is formed by the above framework structure in conjunction with at least one rectangular horizontal shelf member extending longitudinally between one lateral bracing member and the next lateral bracing member thereby forming a shelf structure. The structure of the present invention is easily assembled or disassembled without any additional members and without the aid of tools other than a small mallet.

25 Claims, 6 Drawing Figures

SHELVING STRUCTURE

BACKGROUND OF THE INVENTION

The present invention relates to a shelving structure, more particularly, to a vertical framework extendable in both lateral and longitudinal directions. The shelving structure of the present invention can be assembled without any additional members such as screws or bolts and without the aid of tools other than a small mallet.

There have been proposed various types of knockdown shelving structures. For example, U.S. Pat. No. 3,244,127 issued Apr. 5, 1966 to Robert J. Evans discloses a knockdown type cantilever shelving. Shelvings can be installed at the both sides of the central posts. The shelving is extendable longitudinally but it is not extendable in front to rear direction. U.S. Pat. No. 3,693,556 issued Sept. 26, 1972 to Pierre Rous discloses sectional shelvings employing vertical uprights, each upright consisting of a member having in horizontal section or cross-sectional view the general shape of a hollow "T" of which the wing corresponding to the upper branch of the T is adapted to be positioned on the corresponding face of the shelving, the two walls of the central leg of the T constituting this hollow section being provided with a series of regularly spaced perforations throughout the height or length of the upright. The sectional shelvings according to U.S. Pat. No. 3,693,556 is extendable in longitudinal direction only. The Rous U.S. Pat. No. 3,487,790 issued Jan. 6, 1970 is also of that type.

U.S. Pat. No. 3,672,515 issued June 27, 1972 to Pierre Rous discloses a shelving structure which is extendable both in the longitudinal and in the front-to-rear directions. The shelving structure of U.S. Pat. No. 3,672,515 employs uprights interconnected by longitudinal and cross members having at both ends thereof a fastening inner plate which has a pair of fastening lugs adapted to fit the perforations provided in the corresponding upright.

The principal object of the present invention is to provide a knockdown type shelving structure which is extendable in both lateral and longitudinal directions and which can be easily assembled or disassembled without any additional members and without any specialized tools.

Another object of the present invention is to provide such a shelving structure as above which is adaptable for assembling heavy duty storage racks of various sizes.

DETAILED DESCRIPTION OF THE INVENTION

In accordance with the present invention there is provided a vertical framework structure extendable in both lateral and longitudinal directions comprising a plurality of vertical columns, each column being a tubular member having a rectangular cross-section thereby forming four vertical faces consisting of a front face, a back face and a pair of side faces, each side face being provided with a series of pairs of spaced mounting slots, the mounting slots being horizontally and vertically aligned; at least one lateral bracing member extending horizontally between a pair of front and rear vertical columns, each end of said lateral bracing member being formed with at least two mounting lugs projecting at right angles to the plane of the bracing member, arranged in vertical alignment and spaced apart vertically a distance equal to the spacing of the mounting slots on the column.

In a further aspect the present invention provides such a structure wherein said lateral bracing member has at a side surface thereof one or more upwardly extending shelf support flanges, and said structure further comprising at least one rectangular horizontal shelf member made of sheet metal and extending longitudinally between one lateral bracing member and the next lateral bracing member thereby forming a shelf structure, said retangular horizontal shelf member having a downwardly extending lateral and longitudinal periphery, the longitudinally opposite ends of said rectangular horizontal shelf member being adapted to engage with flanges of the horizontal lateral bracing members.

Other objects and features of this invention will more fully become apparent in view of the following detailed description taken in conjunction with the accompanying drawings illustrating preferred embodiments.

DETAILED DESCRIPTION OF THE DRAWINGS

Figure 6:
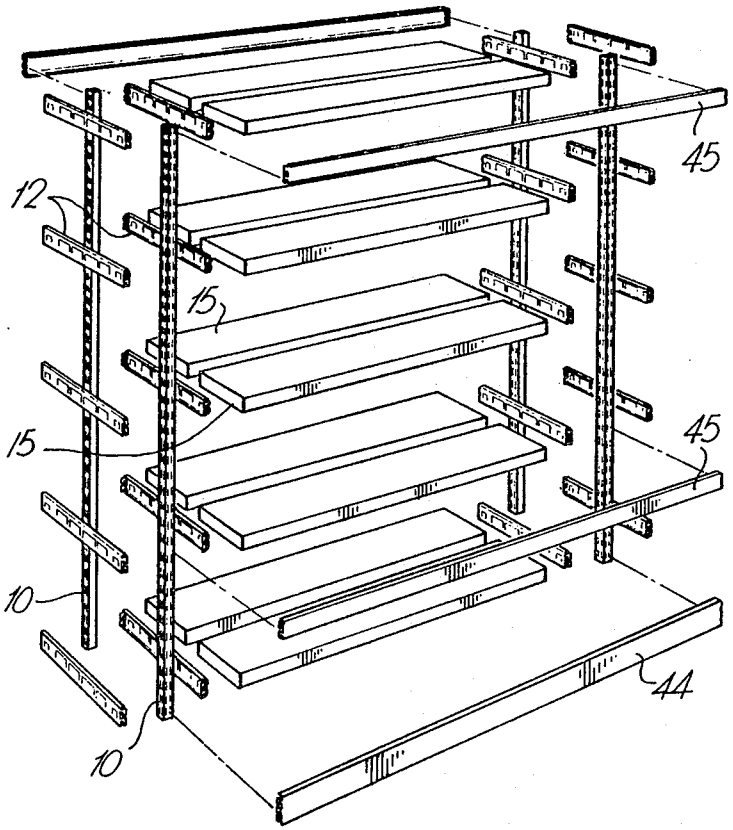
FIG. 6 is an exploded perspective view of an assembled shelf structure made from parts as shown in FIGS. 1 to 5.
Figure 4:
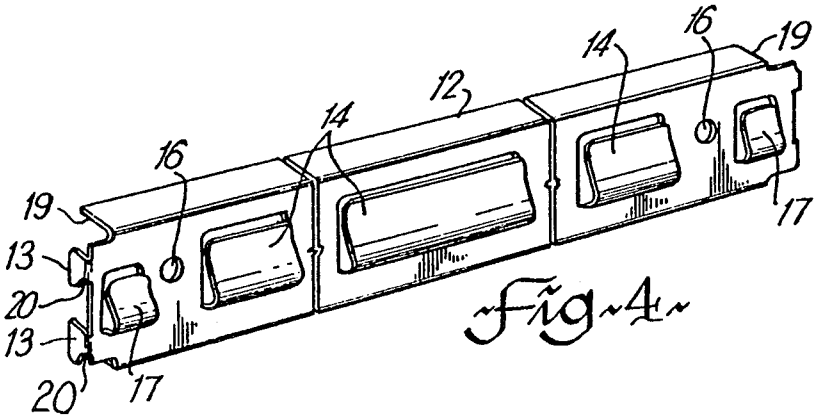
FIG. 4 is a perspective view of one of the bracing members of the embodiment illustrated in FIGS. 1 and 2.

Now referring to the drawings, the vertical framework structure of this embodiment of the invention comprises a plurality of vertical columns 10. Each column is a tubular member having a rectangular cross-section framing four vertical faces consisting of a front face, a back face and a pair of side faces. The side faces are provided with a series of pairs of spaced mounting slots 11. The front face is also preferably provided with such slots, and most preferably all four faces are so provided. Each horizontal pair of the mounting slots 11 are aligned and each vertical pair of the mounting slots are also aligned. Horizontal lateral bracing members 12 interconnect the vertical columns and provide shelf support. Each lateral bracing member 12 has at the both ends thereof a pair of mounting lugs 13 projecting at right angles to the plane of the bracing member. The pair of mounting lugs are spaced apart vertically a distance equal to the spacing of the mounting slots 11 of the column. Moreover, as shown in FIG. 6, even if the framework is not to be further expanded longitudinally, the lateral members 12 are advantageously attached in pairs to both side faces of the two columns 10 at each vertical level. This arrangement creates a rigid end frame that provides overall stability in the framework structure.

In a preferred embodiment the vertical columns are longitudinally interconnected for better rigidity by one or more bracing members having a similar structure to the bracing members 12 but without shelf support flanges 14. As shown in FIG. 6, a longitudinal bracing member 44 is installed at the bottom of the vertical framework structure. Bracing member 44 is of such a depth that it is provided with three lugs 13 on each end, thus providing greater rigidity to the resulting structure. Such longitudinal bracing members may be made to any desired depth, and provided at each end with a suitable number of lugs 13 fitted to slots 11. Longitudinal bracing member 45 is narrower, and has only two lugs 13 at each end. This may well be sufficient for most purposes. In particular, in the embodiment shown in FIG. 6, a bracing member 45 has been installed at the level of the first shelf above the ground, in which case it strengthens the shelf and protects the edge of the shelf against careless workmen who may tend to use it as a step. Any workman standing on the first shelf up from the ground will stand on longitudinal bracing member 45 and take the load away from the edge of the second shelf. As can be seen from FIG. 6 in particular the framework may be made in any number of multiples, and may extend indefinitely in the longitudinal direction or for that matter in the lateral direction.

The longitudinal bracing members such as members 44 and 45 provide very good rigidity to the structure and helps to avoid the disadvantages of the prior art, namely the need for supplementary bracing, bolting or welding of members, or the provision of back panels on shelves for rigidity. Thus the present invention may provide a clean and simple structure, easily assembled without the need of special tools, easily disassemblable, and not requiring the complicated and difficult reinforcement and bracing means of the prior art. Some such bracing may be desired in certain particular circumstances but the structure as shown in FIG. 6 for example is comparatively strong and rigid.

A typical structure constructed along the lines of FIG. 6 may have eight levels a foot apart, for a total height of approximately eight feet. It is found expedient to provide such a structure with a top longitudinal bracing member 45 and a bottom longitudinal bracing member 44 on the back and front of the structure, and this is found to give sufficient rigidity for most uses.

Figure 2:
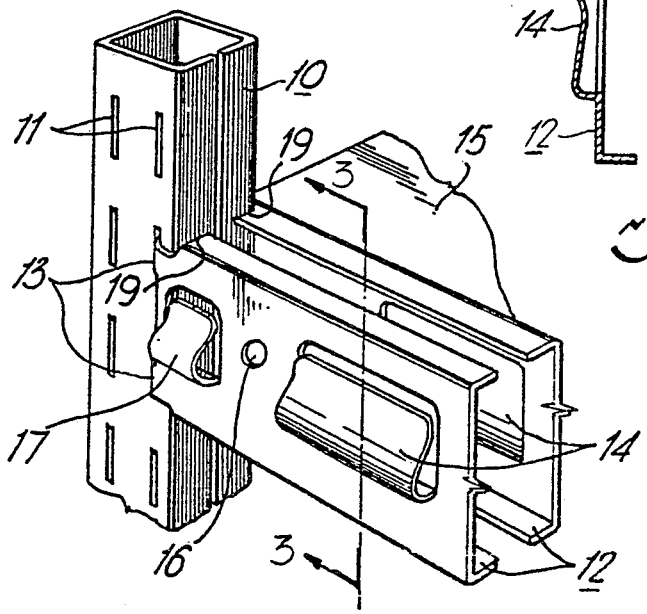
FIG. 2 is a fragmentary perspective view showing a column together with a pair of bracing members secured to said column, of the embodiment shown in FIG. 1.

As shown in FIG. 2 the bracing member 12 locks onto the column post 10 by means of lugs 13 which are perpendicular to the plane of the lateral bracing member 12. The distance between the lugs 13 and the adjacent upper and lower shoulders 19 of the bracing member 12 is held to close tolerance (within 0.005 in. of the distance between the front or back face of the column and the near edge of the vertical slots 11) so that when the lugs 13 are pressed into place there is a tight fit between the shoulders and lugs and the surfaces of the column which they span and engage. The combination of this very rigid and easily mounted and dismounted connection means with the rectangular column 10 is not shown in the prior art and provides a very effective structure for many uses.

The columns 10 and bracing members 12 may be made of any suitable material, such as galvanized or painted cold rolled steel. Eighteen gauge steel has been found to be suitable, with seventeen gauge, a slightly heavier material, being found advantageous for heavier loads.

Figure 1:
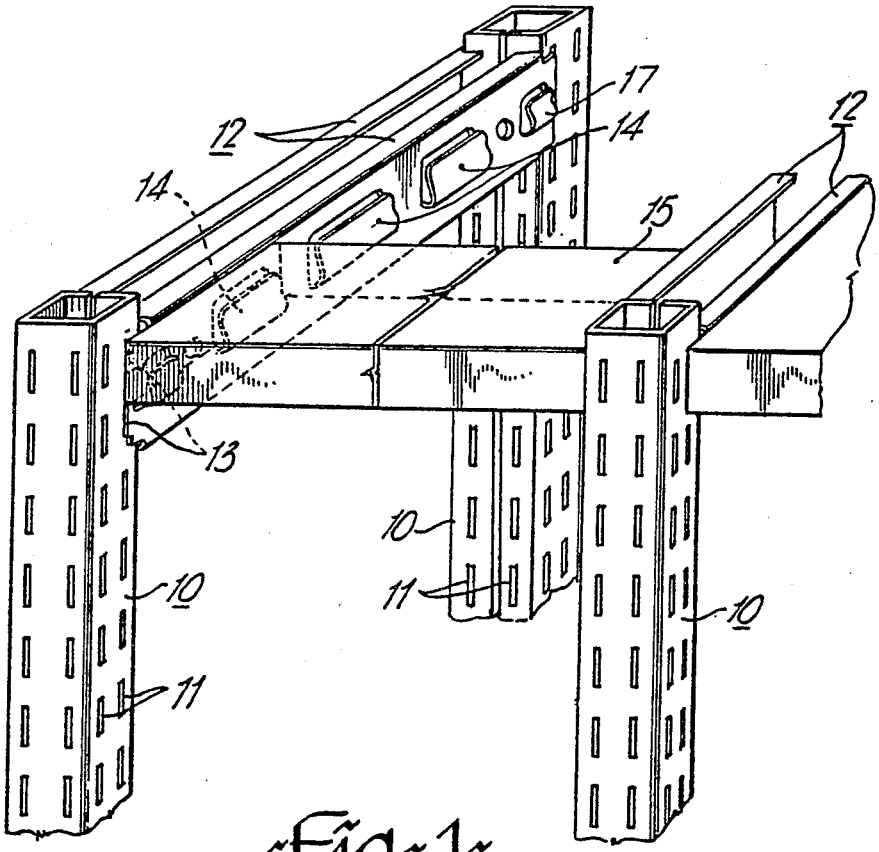
FIG. 1 is a perspective view of a portion of a vertical framework structure of an embodiment of this invention.
Figure 3:
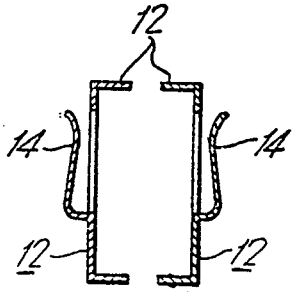
FIG. 3 is a cross-section along the lines 3—3 in FIG. 2.

The column 10 may have an open slot along the back face, with (FIG. 1) or without (FIG. 2) paired slots 11 thereon. The provision of an open slot in the back provides a possibility of slipping a sheet of metal down into the slot to bridge adjacent columns in the lateral direction, namely to form partitions or strengthening members where desired, extending from the front of the shelf to the back. Where this is not desired, or where maximum column strength is required the slot at the back may be absent and the edges of the column may meet. For maximum strength the edges should be welded to form a unitary rectangular, preferably square, post. It has been found useful to provide the columns 10 in a size of 2.5 centimeters and 4 centimeters square.

Each mounting lug 13 has a locking means formed by a downward projection 20 at the lower portion thereof which has a slanted edge that engages the bottom edge of the slot 11 and draws the vertical surface of the member 12 tightly against the side face of the column. When higher strength is unnecessary, the locking means may be provided on only either one of the pair of mounting lugs. The lateral bracing member 12 in this embodiment is provided with at least one upwardly extending shelf support flange 14 having a S-letter shaped cross section on which a shelf 15 may be mounted.

The shelf support flanges 14 may be eliminated from the horizontal lateral bracing member 12 when the vertical framework structure is employed without shelves. In a preferred form, the lateral bracing member 12 has at each end thereof an upwardly extending shelf support flange 17 which is shorter in lateral length than the flange 14. The presence of this flange 17 gives stability to the support of the shelf and allows it to support even a substantially off-center load. In this embodiment there is adjacent to the flange 17 a hole 16, which is provided for manufacturing convenience.

Figure 5:
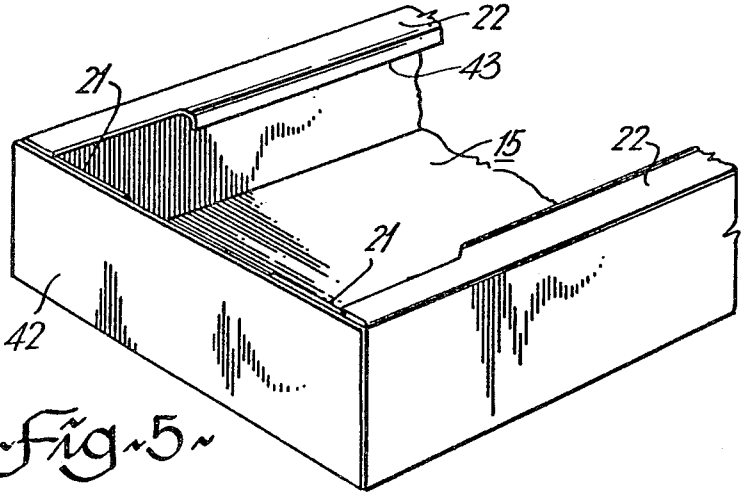
FIG. 5 is a fragmentary perspective upside down view of one of the rectangular horizontal shelf members illustrated in FIG. 1.

In FIG. 5, there is shown upside down, in perspective, a shelf structure of one embodiment of this invention. In this embodiment the shelf is formed from a single metal sheet. The folded-in flap 21 together with the adjacent edge of end panel 42 enable tight engagement of the shelf 15 with a shelf support flange 14. Higher strength is provided by inwardly extending side flanges 22 and upwardly extending further flanges 43 in this embodiment. The width of a shelf 15 can be varied depending on the application thereof.

The embodiments of the invention in which an exclusive property or privilege is claimed are defined as follows:

1. In a vertical framework shelving structure extendable in both lateral and longitudinal directions including, in combination:

at least four vertical columns, each column being a tubular member having a rectangular cross-section thereby forming four vertical faces consisting of a front face, a back face and a pair of side faces, each side face being provided with a series of pairs of spaced mounting slots, the mounting slots being both horizontally and vertically aligned;

at least two lateral bracing members extending horizontally between and connected to a pair of front and rear vertical columns and at least two additional lateral bracing members extending horizontally between and connected to a second pair of front and rear vertical columns, each end of said lateral bracing members being formed with at least two mounting lugs projecting at right angles to the plane of the bracing member, arranged in vertical alignment with and spaced apart vertically a distance equal to the vertical spacing of the mounting slots on the vertical columns, at least one mounting lug having a locking means at the lower portion thereof and each of said lateral bracing members having at a side surface thereof at least one upwardly extending shelf support flange, and at least one rectangular horizontal shelf member made of sheet metal and extending longitudinally between one lateral bracing member and the next horizontally disposed lateral bracing member thereby defining a shelf structure, said rectangular horizontal shelf member having a downwardly extending lateral and longitudinal periphery, the longitudinally opposite ends of said rectangular horizontal shelf member being adapted to engage with the upwardly extending shelf support flanges of the horizontal lateral bracing members.

2. The vertical framework shelving structure as claimed in claim 1 wherein each of said lateral bracing members has an upper and lower shoulder substantially at right angles with respect to the plane of the lateral bracing member such that when the adjacent mounting lugs engage the correspondingly vertically aligned mounting slots a rigid fit is established between the shoulders, lugs and vertical column surfaces engaged by the shoulders.

3. The vertical framework shelving structure as claimed in claim 1 wherein each lug locking means forms with the adjacent bracing member part, a tapered slot narrowing down to the thickness of the wall material of the vertical column, and making a press fit with the wall of the vertical column.

4. The vertical framework shelving structure as claimed in claim 1 wherein at least one longitudinal bracing member is provided, said longitudinal bracing member extending horizontally between and connected to one of the front and one of the rear vertical columns of the two pairs of vertical columns, each longitudinal bracing member being provided at each end with at least two mounting lugs projecting at right angles to the plane of the longitudinal bracing member, arranged in vertical alignment and spaced apart vertically a distance equal to the spacing of mounting slots on the front face of the vertical column, at least one mounting lug having a locking means at the lower portion thereof.

5. The vertical framework shelving structure as claimed in claim 4 wherein each of said longitudinal bracing members has an upper and lower shoulder substantially at right angles with respect to the plane of the bracing member such that when the adjacent mounting lugs engage the correspondingly vertically aligned mounting slots a rigid fit is established between the shoulders, lugs and vertical column surfaces engaged by the shoulders.

6. The vertical framework shelving structure as claimed in claim 4 wherein the longitudinal bracing member presents at least one integral upstanding S-flange for the support of said shelf member, said shelf member extending longitudinally between flanges on the longitudinal bracing members in place on adjacent front and rear columns.

7. The vertical framework shelving structure as claimed in claim 6 wherein the S-flanges are formed by punching or shearing and forming the material of the vertical web of the bracing member.

8. The vertical framework shelving structure as claimed in claim 7 wherein the vertically and horizontally aligned pairs of slots are provided on a front face of the vertical columns as well as on the side faces.

9. The vertical framework shelving structure as claimed in claim 8 wherein the vertically and horizontally aligned pairs of slots are provided on all four faces of the vertical columns.

10. The vertical framework shelving structure as claimed in claim 1 wherein the rectangular cross-section of the tubular member is a square cross-section.

11. In a vertical framework shelving structure extendable in both lateral and longitudinal directions including, in combination at least four vertical columns, each column being a tubular member having a rectangular cross-section thereby forming four vertical faces consisting of a front face, a back face and a pair of side faces, each side face and one of the front face or the back face being provided with a series of pairs of spaced mounting slots, the mounting slots being both horizontally and vertically aligned;

at least two lateral bracing members extending horizontally between and connected to a pair of front and rear vertical columns and at least two additional lateral bracing members extending horizontally between and connected to a second pair of front and rear vertical columns, each end of said lateral bracing members being formed with at least two mounting lugs projecting at right angles to the plane of the bracing member, arranged in vertical alignment with and spaced apart vertically a distance equal to the vertical spacing of the mounting slots on each of the vertical columns and engaging one set of vertical mounting slots, at least one mounting lug having a locking means at the lower portion thereof;

at least two longitudinal bracing members extending horizontally between and connected to one of the front or rear and the other of the front or rear vertical columns of the pairs of vertical columns, each of the said longitudinal bracing members being formed with at least two mounting lugs projecting at right angles to the plane of the longitudinal member, arranged in vertical alignment with and spaced apart vertically a distance equal to the vertical spacing of the mounting slots on the vertical columns, at least one mounting lug having a locking means at the lower portion thereof, each of said lateral bracing members has at the side surface thereof a plurality of upwardly extending shelf support flanges, and at least one rectangular horizontal shelf member made of sheet metal and extending longitudinally between one lateral bracing member and the next lateral bracing member thereby forming a shelf structure, the rectangular horizontal shelf member having a downwardly extending lateral and longitudinally opposite ends adapted to engage with the shelf supporting flanges.

12. In a vertical framework structure extendable in both lateral and longitudinal directions including, in combination;

at least four vertical columns, each column being a tubular member having a rectangular cross-section thereby forming four vertical faces consisting of a front face, a back face and a pair of side faces, each side face and one of the front face or the back face being provided with a series of pairs of spaced mounting slots, the mounting slots being both horizontally and vertically aligned;

at least two lateral bracing members extending horizontally between and connected to a pair of front and rear vertical columns, and at least two additional lateral bracing members extending horizontally between and connected to a second pair of front and rear vertical columns, each end of said lateral bracing members being formed with at least two mounting lugs projecting at right angles to the plane of the bracing member, arranged in vertical alignment with and spaced apart vertically a distance equal to the vertical spacing of the mounting slots on each of the vertical columns, at least one mounting lug having a locking means at the lower portion thereof; and at least two longitudinal bracing members extending horizontally between and connected to one of the front or rear and the other of the front or rear vertical columns of the pairs of vertical columns, each of the said longitudinal bracing members being formed with at least two mounting lugs projecting at right angles to the plane of the longitudinal member, arranged in vertical alignment with and spaced apart vertically a distance equal to the vertical spacing of mounting slots on the front face or the rear face of the vertical columns, at least one mounting lug having a locking means at the lower portion thereof.

13. The vertical framework structure as claimed in claim 12 wherein each of said lateral bracing members has an upper and lower shoulder substantially at right angles with respect to the plane of the bracing member such that when the adjacent mounting lugs engage the correspondingly vertically aligned mounting slots a rigid fit is established between the shoulders, lugs and vertical column surfaces engaged by the shoulders.

14. The vertical framework structure as claimed in claim 12 wherein each of said longitudinal bracing members has an upper and lower shoulder substantially at right angles with respect to the plane of the bracing member such that when the adjacent mounting lugs engage the correspondingly vertically aligned mounting slots a rigid fit is established between the shoulders, lugs and vertical column surfaces engaged by the shoulders.

15. A vertical framework shelving structure as claims in claim 12 wherein each lug locking member part, a tapered slot narrowing down to the thickness of the wall material of the vertical column, and making a press fit with the wall of the vertical column.

16. A vertical framework shelving structure as claimed in claim 12 including at least one rectangular horizontal shelf member extending longitudinally between one lateral bracing member and the next lateral bearing member thereby forming a shelf structure the rectangular horizontal shelf member having a downwardly extending lateral and longitudinally opposite ends of said rectangular horizontal shelf member adapted to engage with the shelf supporting flanges.

17. A vertical framework shelving structure as claimed in claim 16 wherein the longitudinal bracing member presents at least one integral upstanding S-flange for the support of said shelf member, said shelf member being adapted to extend longitudinally between flanges on bracing members in place on adjacent front and rear columns.

18. The vertical framework structure as claimed in claim 12 wherein the vertically and horizontally aligned pairs of slots are provided on all four faces of the vertical columns.

19. The vertical framework structure as claimed in claim 12 wherein the rectangular cross-section of the tubular member is a square-section.

20. In a vertical framework structure extendable in both lateral and longitudinal directions including, in combination at least four vertical columns, each column being a tubular member having a rectangular cross-section thereby forming four vertical faces consisting of a front face, a back face and a pair of side faces, each side face and one of the front face or the back face being provided with a series of pairs of spaced mounting slots, the mounting slots being both horizontally and vertically aligned;

at least two sets of lateral bracing members arranged in opposing pairs extending horizontally between and connected to a pair of front and rear vertical columns, and a second set of two lateral bracing members arranged in pairs extending horizontally between and connected to a second pair of front and rear vertical columns, each end of said lateral bracing members being formed with at least two mounting lugs projecting at right angles to the plane of the bracing member, arranged in vertical alignment with and spaced apart vertically a distance equal to the vertical spacing of the mounting slots on the vertical columns, at least one mounting lug having a locking means at the lower portion thereof; and at least two longitudinal bracing members extending horizontally between and connected to one of the front or rear and the other of the front or rear vertical columns of the pairs of vertical columns, each of said longitudinal bracing members being formed with at least two mounting lugs projecting at right angles to the plane of the longitudinal member, arranged in vertical alignment with and spaced apart vertically a distance equal to the vertical spacing of the mounting slots on the vertical columns, at least one mounting lug having a locking means at the lower portion thereof.

21. The vertical framework structure as claimed in claim 20 wherein each lug locking means forms with the adjacent bracing member part, a tapered slot narrowing down to the thickness of the wall material of the vertical column, and making a press fit with the wall of the vertical column.

22. The vertical framework structure as claimed in claim 20 wherein each of said lateral bracing members and each of said longitudinal bracing members have an upper and lower shoulder substantially at right angles with respect to the plane of each bracing member such that when the adjacent mounting lugs engage the correspondingly vertically aligned mounting slots a rigid fit is established between the shoulders, lugs and vertical column surfaces engaged by the shoulders.

23. The vertical framework structure as claimed in claim 20 wherein the lateral bracing member presents at least one integral upstanding S-flange for the support of said shelf member, said shelf member extending between flanges on the lateral members in place on adjacent front and rear columns.

24. The vertical framework structure as claimed in claim 23 further including at least one rectangular horizontal shelf member extending longitudinally between one of said pairs of lateral bracing members and one of the horizontally opposed pairs of the lateral bracing member thereby forming a shelf structure, the rectangular horizontal shelf member having downwardly extending ends adapted to engage with the shelf supporting flanges.

25. A vertical framework structure as claimed in claim 20 wherein the vertically and horizontally aligned pairs of slots are provided on all four faces of the vertical columns.

* * * * *